US011542695B2

(12) United States Patent
Danielsson Spogardh et al.

(10) Patent No.: US 11,542,695 B2
(45) Date of Patent: Jan. 3, 2023

(54) WASH STAND

(71) Applicant: GEBERIT INTERNATIONAL AG, Jona (CH)

(72) Inventors: Stefan Danielsson Spogardh, Asarum (SE); Marco Oberholzer, Eschenbach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 0 days.

(21) Appl. No.: 17/042,675

(22) PCT Filed: Mar. 28, 2019

(86) PCT No.: PCT/EP2019/057887
§ 371 (c)(1),
(2) Date: Sep. 28, 2020

(87) PCT Pub. No.: WO2019/185812
PCT Pub. Date: Oct. 3, 2019

(65) Prior Publication Data

US 2021/0123222 A1 Apr. 29, 2021

(30) Foreign Application Priority Data

Mar. 29, 2018 (EP) ..... 18164990
Jul. 9, 2018 (EP) ..... 18182527

(51) Int. Cl.
*E03C 1/22* (2006.01)

(52) U.S. Cl.
CPC ..... *E03C 1/22* (2013.01)

(58) Field of Classification Search
CPC ..... A47K 3/40–405; E03C 1/22; E03F 2005/065; E03F 5/0407–0408; E03F 5/0411; E04H 4/14
See application file for complete search history.

(56) References Cited

U.S. PATENT DOCUMENTS 6,427,259 B1 8/2002 Cawthon
9,009,880 B2 * 4/2015 Wedi ..... E03F 5/0408 4/613

(Continued)

FOREIGN PATENT DOCUMENTS

CN 102943512 A 2/2013
CN 109157142 A 1/2019

(Continued)

OTHER PUBLICATIONS

International Search Report for PCT/EP2019/057887 dated Jun. 29, 2019 [PCT/ISA/210].

*Primary Examiner* — David P Angwin
*Assistant Examiner* — Nicholas A Ros
(74) *Attorney, Agent, or Firm* — Sughrue Mion, PLLC

(57) ABSTRACT

A wash stand comprising a wash basin having a drain opening which opens into a drain chamber. In the drain opening there is a cover which extends over part of the drain opening such that, at least in a lower region of the drain opening, a gap is created through which water can flow out of the wash basin into the drain chamber. In the drain chamber there is at least one mounting point on which the cover is supported removably by the at least one mounting point. The cover in the at least one mounting point is mounted pivotably about at least one pivot axis such that the cover can be pivoted from a use position into an intermediate position in which the cover can easily be grasped by a user. From its intermediate position, the cover can be removed from the mounting point out of the drain opening.

9 Claims, 8 Drawing Sheets

(56) References Cited

U.S. PATENT DOCUMENTS

| | | | | |
|---|---|---|---|---|
| 9,739,045 | B1 * | 8/2017 | Jones | A47K 3/00 |
| 10,697,168 | B2 * | 6/2020 | Kozlowski | E03F 5/0408 |
| 2011/0126350 | A1 * | 6/2011 | Wedi | E03F 5/0408 4/613 |
| 2016/0362884 | A1 * | 12/2016 | Mahdjoubi Namin | E03B 1/041 |
| 2018/0155915 | A1 * | 6/2018 | Meyers | E03F 5/0408 |

FOREIGN PATENT DOCUMENTS

| | | | | | |
|---|---|---|---|---|---|
| DE | 10 2008 044 637 | A1 | | 10/2009 | |
| DE | 20 2011 000 278 | U1 | | 6/2011 | |
| DE | 202011000278 | | * | 7/2011 | E03C 1/22 |
| DE | 20 2011 050 604 | U1 | | 10/2012 | |
| DE | 10 2012 102 929 | A1 | | 10/2013 | |
| DE | 202014007356 | | * | 12/2014 | E03C 1/22 |
| EP | 2728078 | | * | 5/2014 | E03F 5/04 |
| GB | 2560009 | | * | 8/2018 | E03C 1/22 |
| JP | 8-144343 | A | | 6/1996 | |
| KR | 10-2017-0028819 | A | | 3/2017 | |
| WO | 2018/100220 | A1 | | 6/2018 | |

* cited by examiner

WASH STAND

CROSS REFERENCE TO RELATED APPLICATIONS

This application is a National Stage of International Application No. PCT/EP2019/057887, filed on Mar. 28, 2019, which claims priority from European Patent Application No. 18164990.6, filed on Mar. 29, 2018, and European Patent Application No. 18182527.4, filed on Jul. 9, 2018.

TECHNICAL FIELD

The present invention relates to a wash stand with a cover element according to the preamble of claim 1.

PRIOR ART

Wash stands with cover elements, which are inserted in a run-off, are known from the prior art. By way of example, DE 10 2008 044 637 discloses a wash stand, in the run-off opening of which a cover is inserted. A disadvantage of the cover according to DE 10 2008 044 637 is that the cover can be removed only in a comparatively complex manner. The removability of the cover is important, so that the regions behind the cover can be cleaned. For example, hair and other solid matter accumulate behind the cover. This solid matter has to be removed, since otherwise the water is no longer able to flow out adequately.

DESCRIPTION OF THE INVENTION

Proceeding from this prior art, the invention is based on an object of specifying a wash stand with a cover, said wash stand overcoming the disadvantages of the prior art. In particular, it is an object of the present invention to specify a wash stand with a cover, with the cover being able to be removed from the wash stand in a simple manner by the user.

This object is achieved by the subject matter as claimed in claim 1. Accordingly, a wash stand comprises a wash basin with a run-off opening which opens into a run-off chamber. The wash stand further comprises a cover element which is arranged in the run-off opening and which extends partially across the run-off opening in such a way that, at least in a lower region of the run-off opening, a gap is provided, through which water can flow out of the wash basin into the run-off chamber. In the run-off chamber, there is arranged at least one bearing point on which the cover element is mounted in such a way that it can be removed from the at least one bearing point. This means that the cover element can be connected to the bearing point, and the connection can be canceled again during maintenance. The cover element is mounted in the bearing point so as to be able to pivot about at least one pivot axis, in such a way that the cover element can be pivoted from a use position into an intermediate position, in which the cover element can be readily gripped by a user. Furthermore, the cover element, from its intermediate position, can be removed from the bearing point out of the run-off opening.

The wash stand with the cover element which can be pivoted into an intermediate position achieves the object in that the cover element can be moved in a simple manner into the intermediate position, and can subsequently be readily gripped by the user. As a result of the pivoting movement, the cover element, in its intermediate position, lies in the run-off opening in an angularly inclined manner, as a result of which the cover element can be readily gripped.

The bearing point is preferably arranged in such a way that the bearing point is not visible when the cover element is in the use position.

Preferably, the front face of the cover element is flush with the surface of the wash basin all around the run-off opening.

Preferably, the cover element, in its intermediate position, projects partially out of the run-off chamber and extends, with the region projecting out of the run-off chamber, from the run-off chamber into the wash basin. The user can then grip the cover element on the region thereof which extends into the wash basin, and can subsequently separate the connection between cover element and bearing point and remove the cover element from the run-off chamber.

Preferably, the cover element can be moved from the use position into the intermediate position by application of pressure on the front face thereof, which faces toward the wash basin. Hereby, a simple actuation can be achieved.

Preferably, the bearing point is arranged centrally with respect to the cover element, in such a way that the cover element can be moved from the use position into the intermediate position by application of pressure on an end region. Alternatively, a plurality of bearing points are arranged symmetrically with respect to the center of the cover element, in such a way that the cover element can be moved from the use position into the intermediate position by application of pressure on an end region.

The term centrally is understood to mean that, in the case of an elongate cover, the center is understood to be the region between the two ends.

Preferably, the pivot axis is oriented substantially parallel to the front face of the cover element and preferably runs substantially in the vertical or substantially in the horizontal. In this connection, substantially means that the pivot axis either runs exactly in the vertical or the horizontal or alternatively at a slightly inclined angle with respect to the vertical or with respect to the horizontal, respectively.

Preferably, in a lateral region and also in an upper region opposite said lower region, a gap is likewise present between the cover element and the run-off opening. This means that a gap which runs around the cover element is preferably provided, through which water can flow into the run-off chamber. In this way, the outflow capacity in the case of a filled wash basin can be increased.

The gap in the lower region is preferably larger than the gap in the lateral region and/or in the upper region. Hereby, the outflow capacity can be optimized.

The gap in the upper and in the lateral region is preferably smaller than the gap in the lower region. Typically, the smaller gap has a clearance of 0.5 millimeters to approximately 3 millimeters. The larger gap, through which the water flows out, has a clearance of 3.5 to 8 millimeters.

The bearing point is preferably part of an insert element, which is configured separately from the wash stand and can be connected to the wash stand.

The insert element preferably closes off the run-off chamber toward the rear and comprises a connection piece through which the water can be discharged. The connection piece is preferably connected to an outflow system.

The cover element preferably has a bearing element on the rear side thereof, said bearing element being mounted in the bearing point. The bearing element preferably protrudes away from the rear side of the cover element and projects into the bearing point. The bearing point and the bearing element are in this case preferably configured in such a way that the front face of the cover element comes to lie flush with the surface of the wash basin around the run-off opening.

Preferably, a comb element with comb teeth is furthermore arranged in the run-off chamber, which comb teeth lie behind the cover element as seen in the direction of flow and project into the clear width of the gap in the lower region for the purpose of retaining solid articles.

In a first variant, the cover element and the comb element are preferably of one-part configuration. This means that the cover element and the comb element are configured in one piece.

According to a second variant, the cover element is configured separately from the comb element, wherein the cover element and the comb element are connected to one another.

The connection between the cover element and the comb element is preferably a materially bonded and/or force-fitting and/or positively locking connection.

In the second variant, the comb element preferably has a bearing element on the rear side thereof, said bearing element being mounted in said bearing point. In this variant, the bearing is independent of the cover element. Alternatively, it is also possible for the cover element to comprise the bearing element.

Preferably, the bearing point and the bearing element each have a contact area which is rounded with a rounded portion and by way of which said pivoting movement can be carried out. The rounded portion of the bearing point is preferably convex and the rounded portion of the bearing element is preferably concave. The two rounded portions are of mutually complementary configuration, such that the rounded portions fit together.

The rounded contact area is preferably rounded in a cylindrical manner, wherein the center axis of the cylindrical rounded portion defines the pivot axis. Alternatively, the rounded contact area is of partially spherical configuration.

The bearing point and the bearing element preferably have a retaining means which increases the separating force between the bearing point and the bearing element, wherein the retaining means is preferably a mechanical snap-fit element and/or a magnetic element.

The cover element, in its use position, is preferably aligned with respect to the wash basin. In particular, the front face of the cover element is oriented parallel to the wall of the wash basin.

Further embodiments are specified in the dependent claims.

BRIEF DESCRIPTION OF THE DRAWINGS

Preferred embodiments of the invention are described below with reference to the drawings, which serve merely for explanation and should not be interpreted as restrictive. In the drawings.

DESCRIPTION OF PREFERRED EMBODIMENTS

Figure 7:
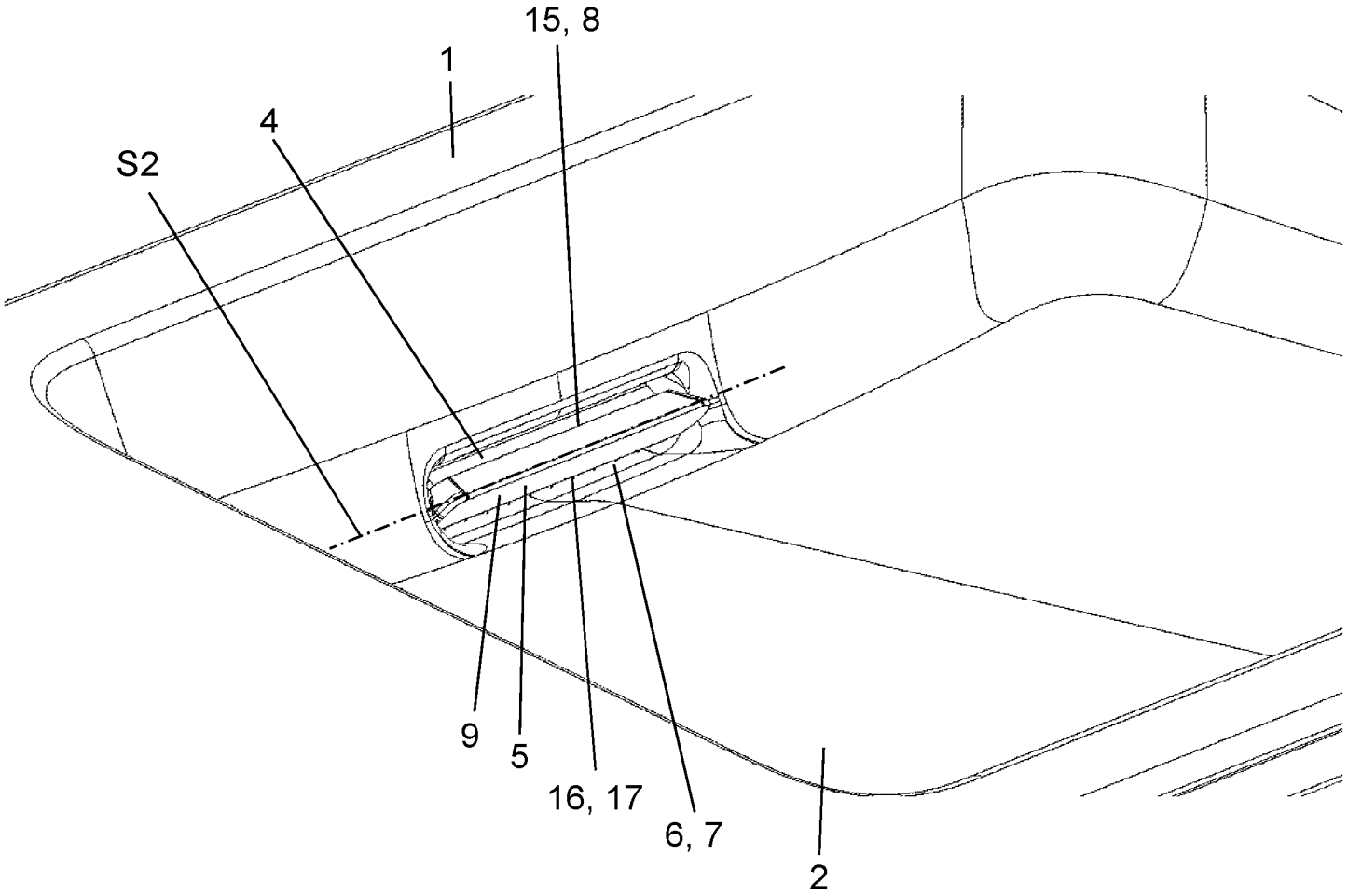
FIG. 7 shows a perspective view of a wash stand according to a further preferred embodiment of the present invention.
Figure 8B:
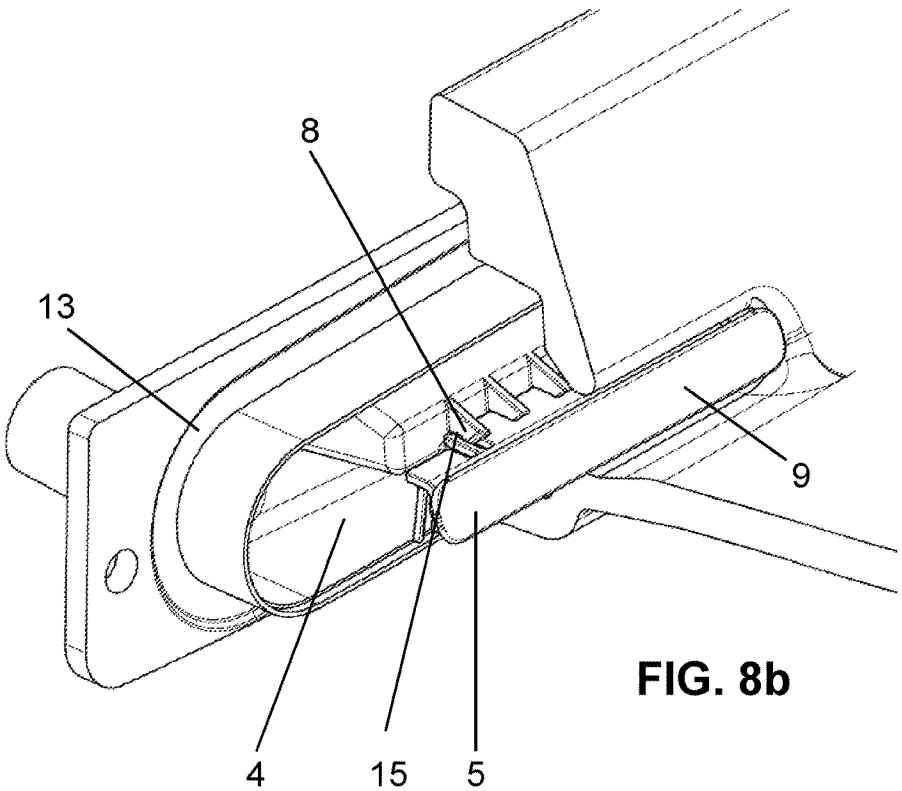
FIGS. 8*a*/8*b* show detailed views of FIG. 7.

FIGS. 1 to 6 show a first embodiment of a wash stand 1 according to the invention. FIGS. 7 to 8*b* show a second embodiment of a wash stand 1 according to the invention. Identical parts are in this case provided with identical reference numerals.

The wash stand 1 comprises a wash basin 2 with a run-off opening 3 which opens into a run-off chamber 4. Water is in this case supplied to the water basin 2 by way of an outlet fitting (not illustrated), and the water can then be guided via the run-off opening 3 to the run-off chamber 4. From the run-off chamber 4, the water is then supplied to a wastewater system. Here, the run-off opening is arranged in a side wall 28 of the wash basin 2.

Figure 1:
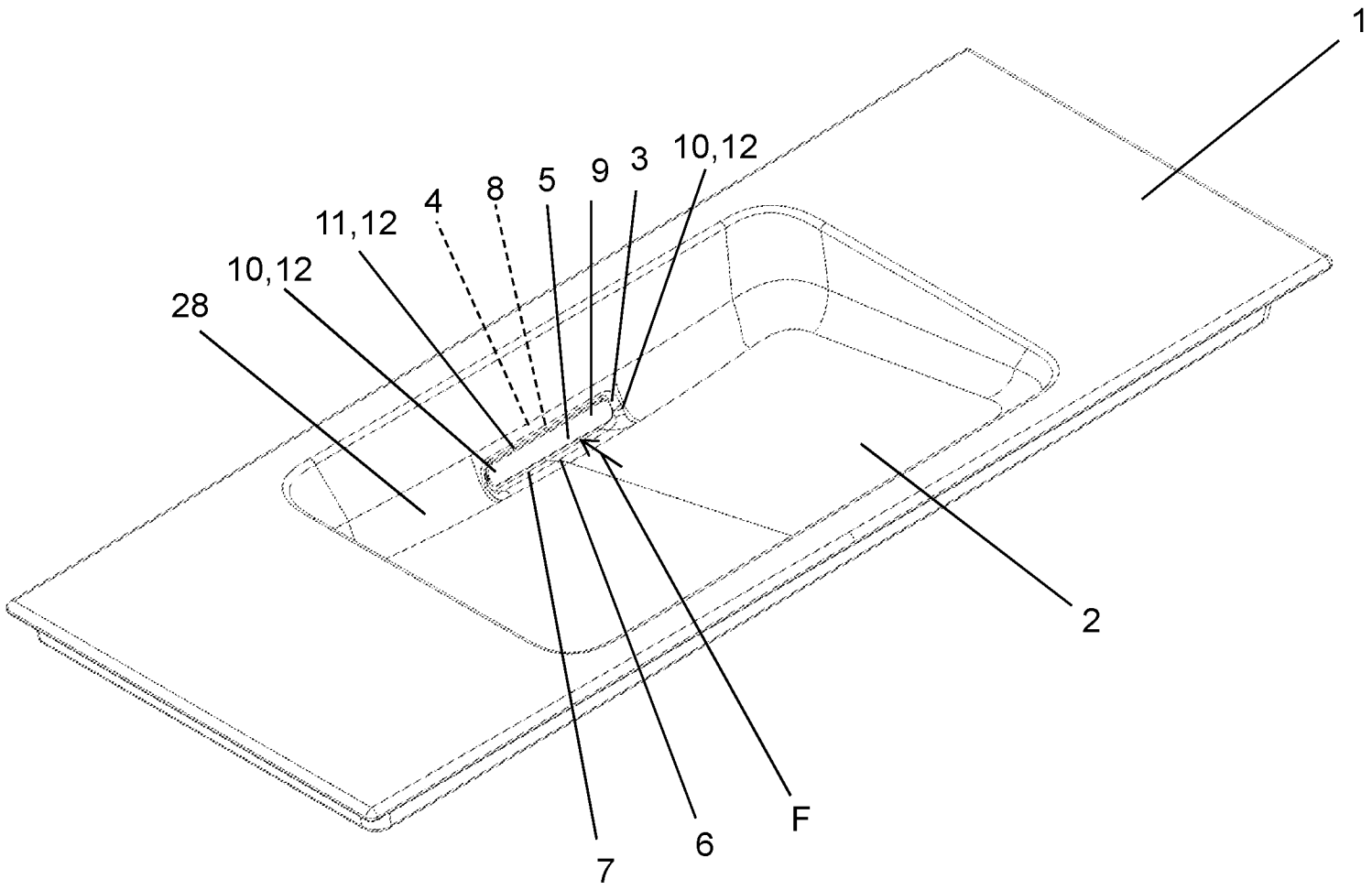
FIG. 1 shows a perspective view of a wash stand according to a preferred embodiment of the present invention.
Figure 2:
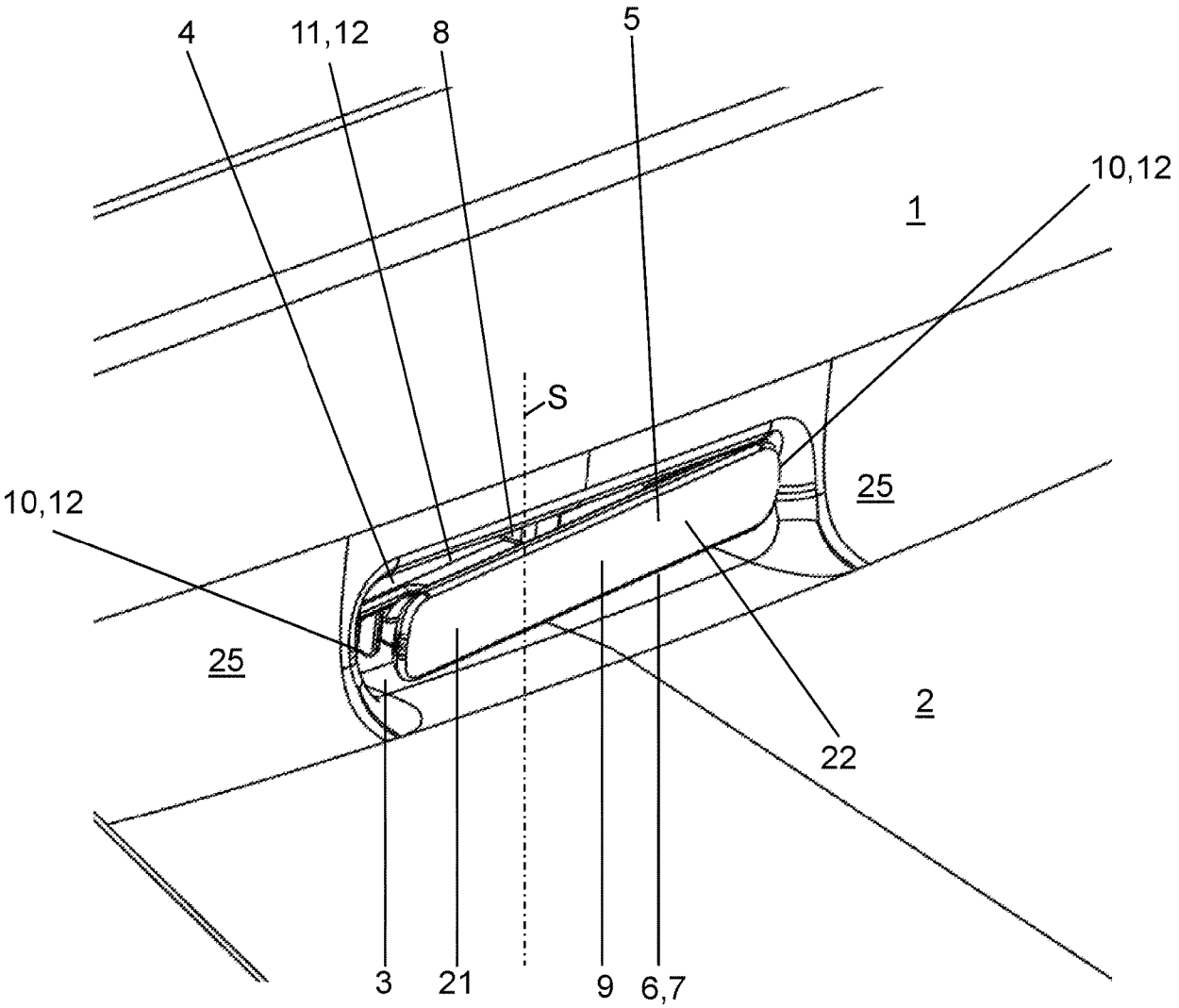
FIG. 2 shows a perspective detail view of the wash stand according to FIG. 1.

A cover element 5 is arranged in the run-off opening 3. The cover element 5 extends partially across the run-off opening 3 in such a way that, at least in a lower region 6 of the run-off opening 3, a gap 7 is provided. Through the gap 7, water can flow out of the wash basin 2 into the run-off chamber 4. The cover element 5 substantially conceals the elements lying in the run-off chamber 4 behind the run-off opening 3. This means that the cover element 5 in its use position, as shown in FIG. 1, lies in the run-off opening 3 in such a way that the interior space of the run-off chamber 4 is concealed.

In the run-off chamber 4, there is arranged at least one bearing point 8 on which the cover element 5 is mounted. In this case, the cover element 5 is mounted in such a way that it can be removed from the at least one bearing point 8. This means that the cover element 5 can be separated from the bearing point 8 and removed from the run-off opening 3. In this way, access to the run-off chamber 4 can be provided through the run-off opening 3.

In this case, the cover element 5 is mounted on the at least one bearing point in such a way that the cover element 5 is mounted so as to be able to pivot about a pivot axis S1, S2. In this case, the cover element 5 can be pivoted from a use position, as is shown in FIG. 1, into an intermediate position, as is shown for example in FIGS. 2 and 7. In the intermediate position, the cover element 5 lies in the run-off opening 3 in such a way that the cover element 5 can be readily gripped by a user. The cover element 5, from its intermediate position, can then be removed from the bearing point 8 out of the run-off opening 3. The access to the run-off chamber 4 is correspondingly provided.

This means that, during removal from the run-off opening 3, the cover element 5 is initially pivoted into the intermediate position and subsequently gripped by the user, wherein the cover element 5, from its intermediate position, is then separated from the bearing point 8 and accordingly removed from the run-off opening 3.

In the first embodiment according to FIGS. 1 to 6, the cover element 5 can be pivoted about a pivot axis S1. In this case, the pivot axis S1 runs substantially in the vertical V or at a slight angular inclination with respect to the vertical V. In the second embodiment according to FIGS. 7 to 8*b*, the cover element 5 is pivoted substantially about the pivot axis S2. In this case, the pivot axis S2 lies in the horizontal H or at a slight angular inclination with respect to the horizontal H.

In both embodiments, the cover element 5, in its intermediate position, projects partially out of the run-off chamber 4. In this case, the cover element 5 extends, with a projecting region 21, from the run-off chamber 4 into the wash basin 2. The user can readily grip the cover element 5 on the projecting region 21. The cover element 5 thus lies, in its intermediate position, in such a way that it extends out of the run-off opening 3.

Preferably, the cover element 5 is moved from the use position into the intermediate position by application of pressure on the front face 9 thereof. With regard to the first embodiment, looking at FIG. 2, this means that the user pushes the right-hand region of the cover element 5 inward into the run-off opening 3 or the run-off chamber 4, respectively, wherein the pivoting about the pivot axis S1 then occurs. After the pivoting, the left-hand side of the cover element 5 then projects as projecting region 21 into the wash basin 2. In the second embodiment according to FIG. 7, the user likewise pushes on the front face 9, but in the lower region of the cover element 5 rather than in the end region. In this way, the cover element 5 is pivoted correspondingly at the pivot axis S2 and the projecting region 21 can be gripped correspondingly.

In both embodiments, the bearing point 8 is preferably arranged centrally with respect to the cover element 5. In particular centrally as seen in the direction of the horizontal H. The arrangement is in this case such that the cover element 5 can be moved from the use position into the intermediate position with an application of pressure on an end region of the cover element 5. Alternatively, a plurality of bearing points 8 can also be arranged symmetrically with respect to the center of the cover element 5, with said bearing points 8 then likewise being arranged in such a way that the cover element 5 can be moved from the use position into the intermediate position by application of pressure on a region. In the first embodiment, a bearing point 8 is arranged centrally with respect to the cover element 5, and in the second embodiment, a plurality of bearing points 8 are arranged slightly offset with respect to the center of the cover element 5.

In the embodiment according to FIGS. 1 to 6, one bearing point is arranged, and in the embodiment according to FIGS. 7 to 8*b*, two bearing points 8 are arranged. The cover element 5 according to the first embodiment has a bearing element 15 on the rear side 14 thereof, and the cover element 5 according to the second embodiment has two bearing elements 15. The bearing element 15 or the bearing elements 15, respectively, engage in the bearing point 8. The cover element 5 is thus mounted with the bearing element 15 in the bearing point 8. In this case, the bearing element 15 projects into the bearing point 8 and is correspondingly accommodated by the bearing point 8.

The cover element 5 preferably lies in the run-off opening 3 in such a way that not only is the gap 7 provided, but a gap which runs circumferentially around the cover element 5 is provided. This means that, in a lateral region 10 of the cover element 5 and also in the upper region 11 opposite said gap, a gap 12 is likewise present between the cover element and the run-off opening 3. The gap 7 in the lower region is preferably larger than the gap 12 in the lateral region 10 or in the upper region 11, respectively.

The bearing point 8 and the bearing element 15 each have a contact area 20 which is rounded with a rounded portion 23. The rounded contact area 20 is advantageous because, as a result, the pivoting movement can be correspondingly defined and executed. In the embodiments shown according to FIGS. 1 to 7, the rounded contact area 20 is rounded in a cylindrical manner. The center axis of the cylindrical rounded portion 23 in this case defines the pivot axis S1. Alternatively, said connection or the rounded portion 23, respectively, can also be provided by a spherical structure.

In the second embodiment according to FIGS. 7 to 8*b*, the bearing point 8 and the bearing element 15 do not have a rounded contact area. Rather, the bearing elements 15 are snap-fit elements which engage correspondingly on the bearing point 8. Here, the pivotability is achieved in that the snap-fit connection is canceled and the cover element is correspondingly pivoted upward or downward.

The bearing point 8 and the bearing element 15 preferably have retaining means. With the retaining means, the separating force between the bearing point 8 and the bearing element 15 is increased. The retaining means is preferably a mechanical snap-fit element or a magnetic element. The combination of said two elements is also conceivable.

The cover element is aligned with respect to the side walls of the wash basin 2. Particularly with respect to the region 25 of the side walls of the wash basin 2 which extend around the run-off opening 3.

Figure 3:
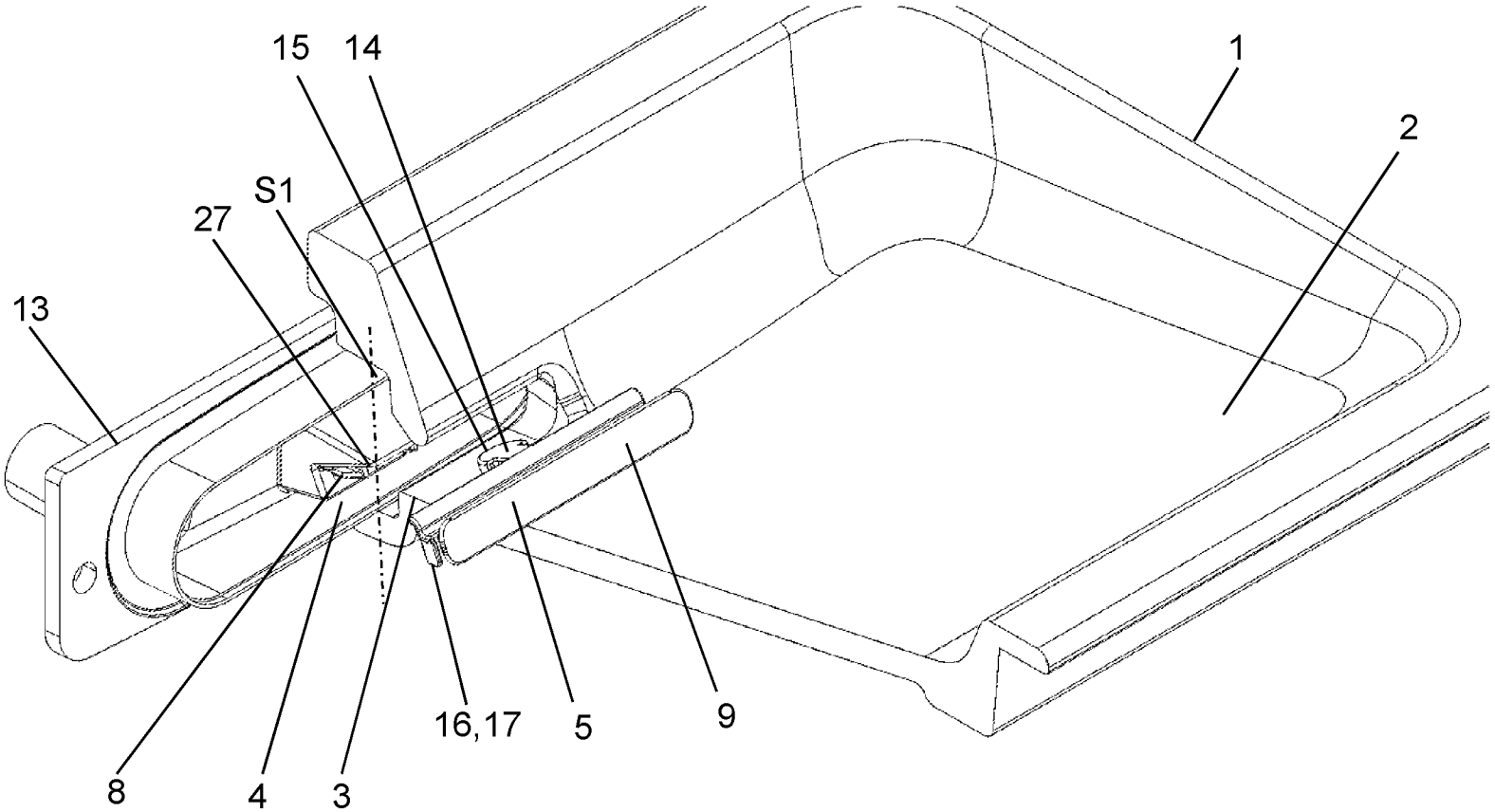
FIG. 3 shows a perspective exploded view of the wash stand according to FIG. 1.
Figure 4:
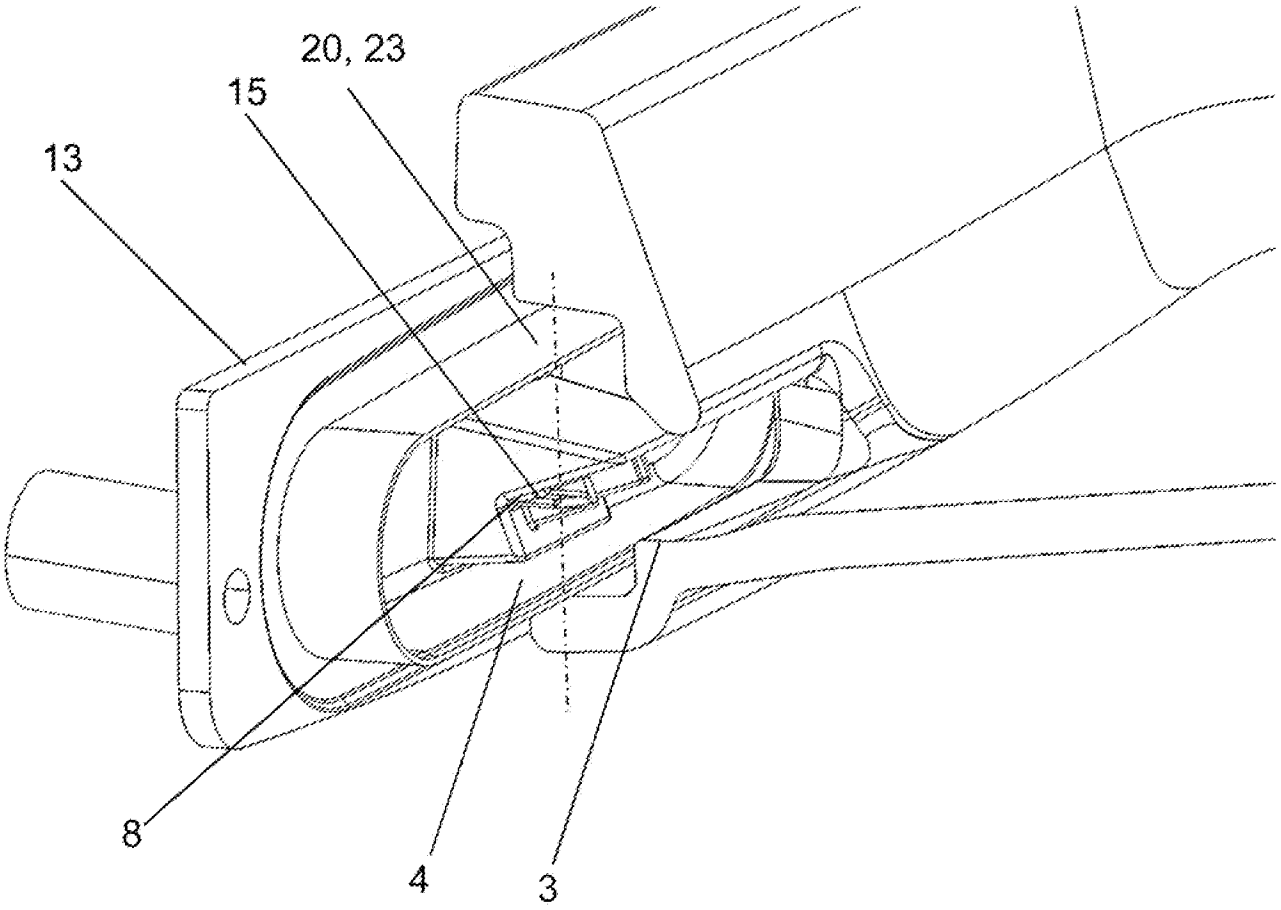
FIG. 4 shows a further perspective illustration of the wash stand according to FIG. 1.
Figure 8A:
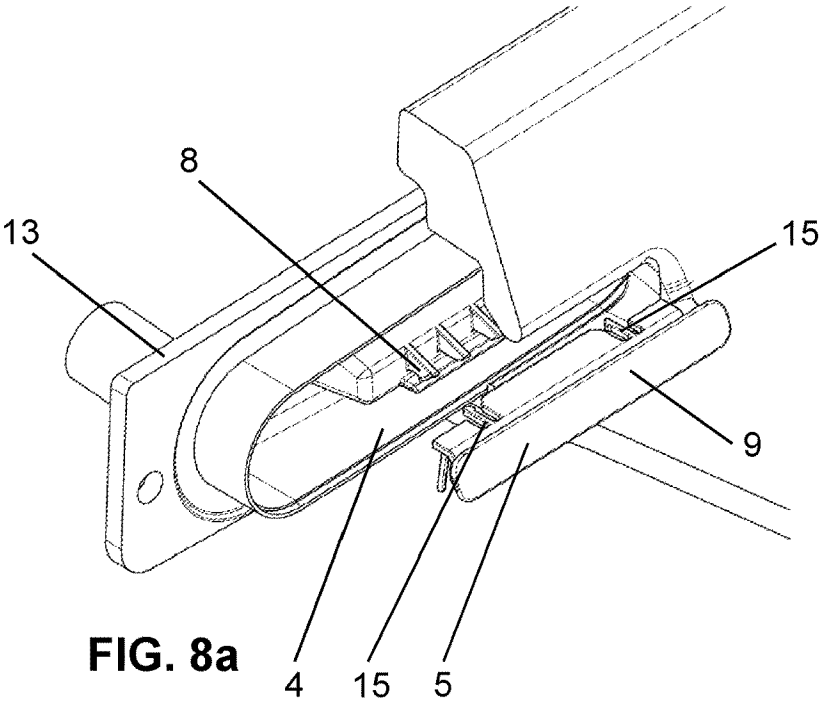

The sectional illustrations of FIG. 3 and also of FIGS. 8*a* and 8*b* show that, in both embodiments shown, the bearing point 8 is part of an insert element 13. The insert element 13 is configured separately from the wash stand 1. The insert element 13 can be connected to the wash stand 1 and is preferably produced as a plastics injection-molded part. In the embodiment shown, the insert element 13 projects from the rear into the run-off chamber 4 and forms a part of the run-off chamber 4. A connection piece 26 is furthermore arranged on the insert element 13, on the rear side thereof with respect to the wash stand 1.

Figure 5:
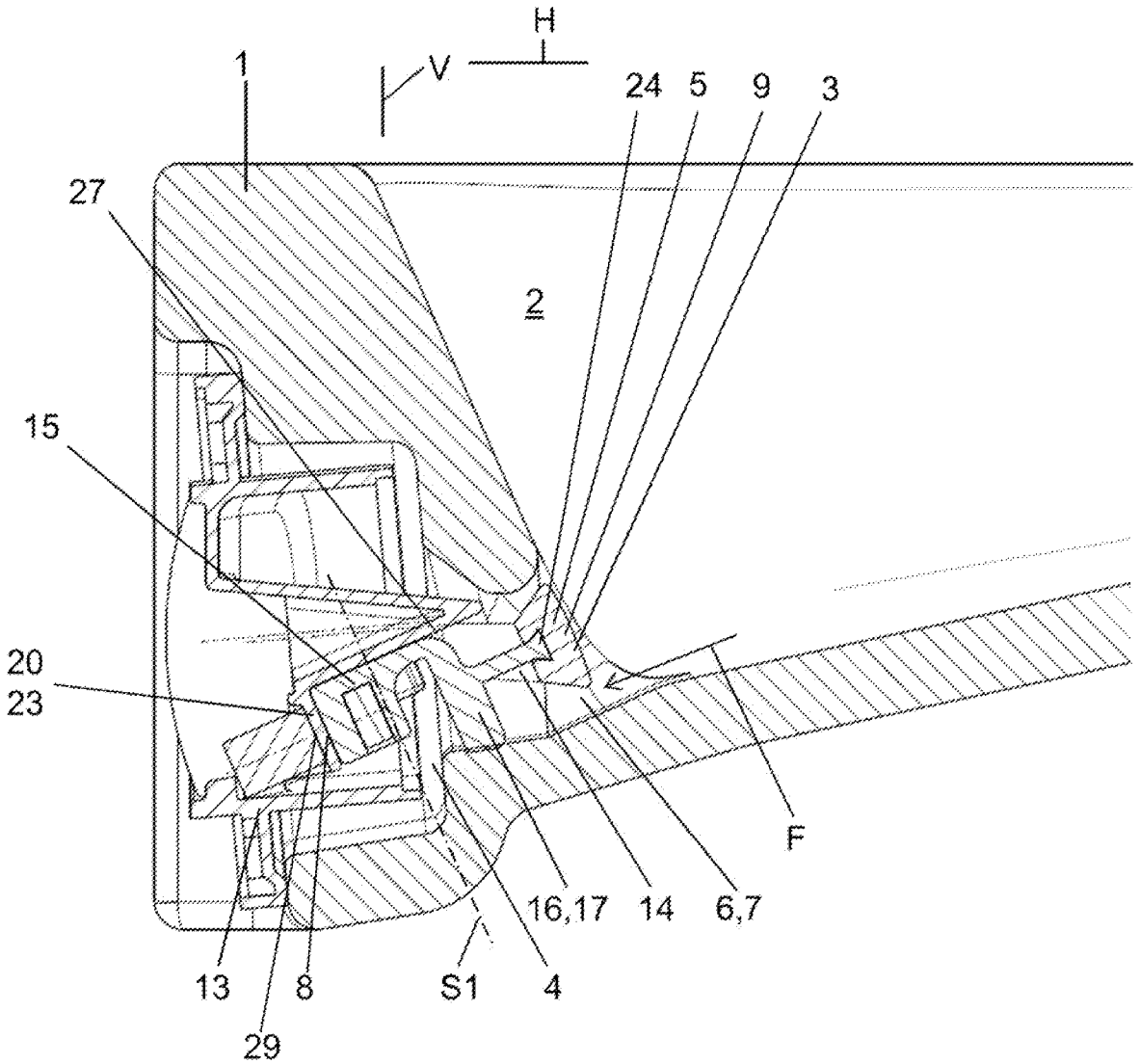
FIG. 5 shows a sectional illustration of the wash stand according to FIG. 1.
Figure 6:
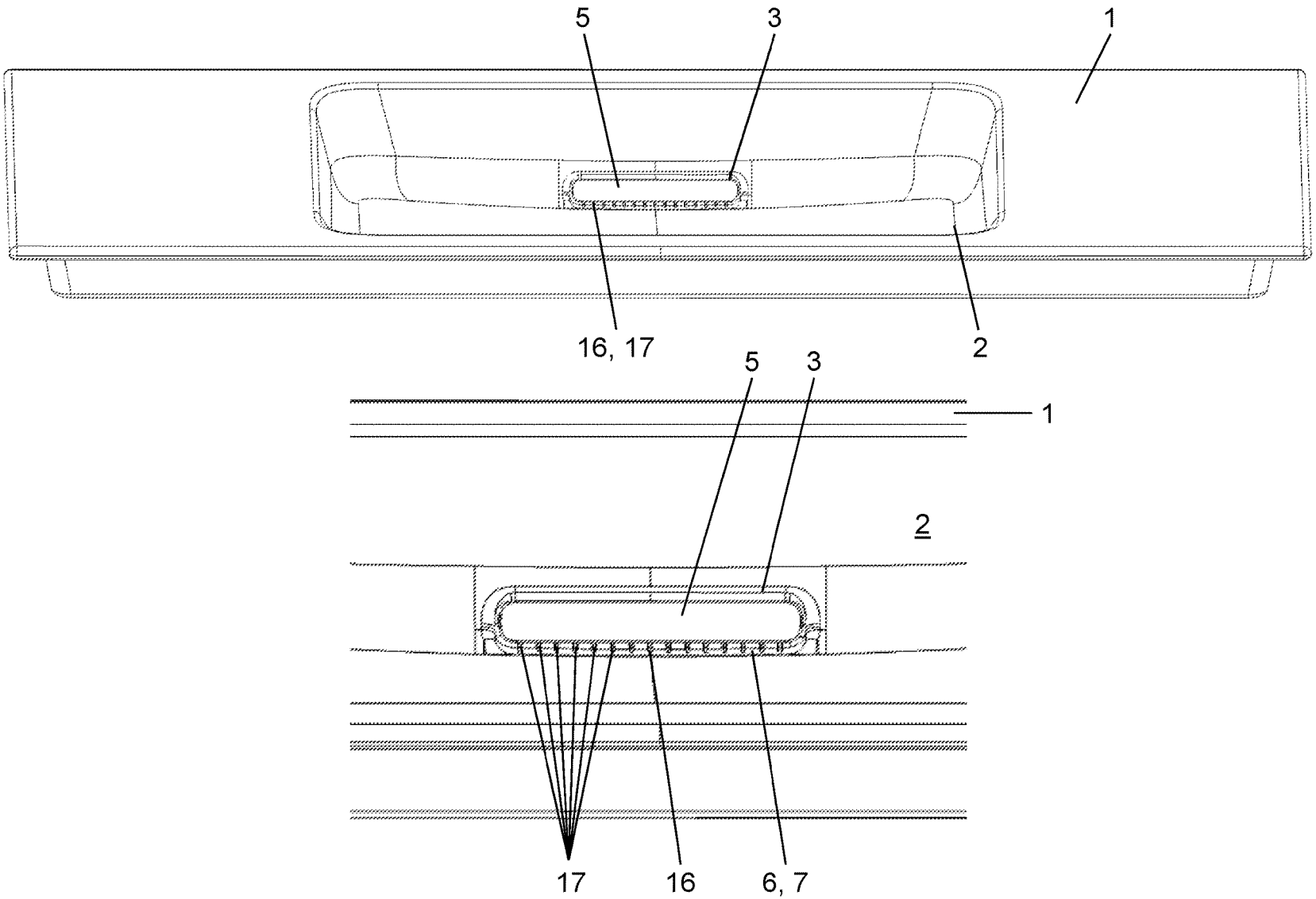
FIG. 6 shows a further perspective view of the wash stand according to FIG. 1 with a detailed view.

In both embodiments, a comb element 16 with comb teeth 17 is furthermore arranged in the run-off chamber 4. The comb element 16 is optional. The comb teeth 17 lie behind the cover element 5 as seen in the direction of flow F and project into the clear width of the gap 7 in the lower region 6. As a result of the comb teeth 17, solid articles, such as, for example, hair, can be retained. FIG. 5 shows that the comb teeth 17 stand on the lower wall of the run-off opening 3. In this way, corresponding articles, which are led in the direction of flow F toward the comb teeth 17, can be stopped before entering the actual run-off chamber 4.

In the embodiments shown, the cover element 5 is configured separately from the comb element 16 and is connected thereto. FIG. 5 shows an exemplary configuration where the comb element 16 is connected to the cover element 5 by way of a dovetail guide 24. Other types of connection are also possible. However, in alternative embodiments, the cover element 5 and the comb element 16 can also be of one-part configuration.

In the embodiment shown, the bearing element 15 is also not arranged directly on the cover element 5 but rather extends away from the comb element 16. In this case, it is also conceivable for the bearing element to extend away from the cover element.

LIST OF REFERENCE NUMERALS

1 Wash stand
2 Wash basin
3 Run-off opening
4 Run-off chamber
5 Cover element
6 Lower region
7 Gap
8 Bearing point

9 Front face
10 Lateral region
11 Upper region
12 Gap
13 Insert element
14 Rear side
15 Bearing element
16 Comb element
17 Comb teeth
20 Contact area
21 Projecting region
22 End region
23 Rounded portion
24 Dovetail guide
25 Regions
26 Connection piece
27 Wall
28 Side wall
F Direction of flow
S1, S2 Pivot axes
V Vertical
H Horizontal

The invention claimed is:

1. A wash stand comprising a wash basin with a run-off opening which opens into a run-off chamber, wherein a cover element is arranged in the run-off opening, said cover element extending partially across the run-off opening in such a way that, at least in a lower region of the run-off opening, a gap is provided, through which water can flow out of the wash basin into the run-off chamber, wherein in the run-off chamber, there is arranged at least one bearing point on which the cover element is mounted in such a way that it can be removed from the at least one bearing point, wherein the cover element is mounted on the at least one bearing point so as to be able to pivot about at least one pivot axis, in such a way that the cover element can be pivoted from a use position into an intermediate position, in which the cover element can be readily gripped by a user, wherein the cover element, from its intermediate position, can be removed from the bearing point out of the run-off opening, wherein a comb element with comb teeth is arranged in the run-off chamber, which comb teeth lie behind the cover element as seen in the direction of flow and project into the clear width of the gap in the lower region for the purpose of retaining solid articles, wherein the cover element is configured separately from the comb element, wherein the cover element and the comb element are connected to one another and wherein the comb element has a bearing element on the rear side thereof, said bearing element being mounted in said bearing point.

2. The wash stand as claimed in claim 1, wherein the cover element, in its intermediate position, projects partially out of the run-off chamber and extends, with the region projecting out of the run-off chamber, from the run-off chamber into the wash basin.

3. The wash stand as claimed in claim 2, wherein the cover element can be moved from the use position into the intermediate position by application of pressure on the front face thereof.

4. The wash stand as claimed in claim 1, wherein the bearing point is arranged centrally with respect to the cover element, in such a way that the cover element can be moved from the use position into the intermediate position by application of pressure on an end region; or wherein a plurality of bearing points are arranged symmetrically with respect to the center of the cover element, in such a way that the cover element can be moved from the use position into the intermediate position by application of pressure on an end region.

5. The wash stand as claimed in claim 1, wherein the pivot axis is oriented parallel to the front face of the cover element .

6. The wash stand as claimed in claim 5, wherein the pivot axis runs in the vertical or in the horizontal.

7. The wash stand as claimed in claim 1, wherein in a lateral region and also in an upper region opposite said lower region, a gap is likewise present between the cover element and the run-off opening.

8. The wash stand as claimed in claim 7, wherein the gap in the lower region is larger than the gap in the lateral region and/or in the upper region.

9. The wash stand as claimed in claim 1, wherein the bearing point is part of an insert element, which is configured separately from the wash stand and can be connected to the wash stand.

* * * * *